US006780375B2

(12) United States Patent
Hirano et al.

(10) Patent No.: US 6,780,375 B2
(45) Date of Patent: Aug. 24, 2004

(54) ALUMINUM ALLOY WITH GOOD CUTTABILITY, METHOD FOR PRODUCING A FORGED ARTICLE, AND FORGED ARTICLE

(75) Inventors: Yoji Hirano, Tokyo (JP); Ryo Shoji, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/419,215

(22) Filed: Apr. 21, 2003

(65) Prior Publication Data

US 2003/0202899 A1 Oct. 30, 2003

(30) Foreign Application Priority Data

Apr. 25, 2002 (JP) ..... 2002-124864

(51) Int. Cl.[7] ..... C22C 21/12

(52) U.S. Cl. ..... 420/530; 420/531; 148/691

(58) Field of Search ..... 420/530, 531; 148/416, 438, 691

(56) References Cited

U.S. PATENT DOCUMENTS

| | | | |
|---|---|---|---|
| 2,026,575 A | 1/1936 | Kempf et al. | |
| 5,725,694 A | 3/1998 | Sircar | 148/439 |
| 5,803,994 A | 9/1998 | Coats, II et al. | |
| 6,113,850 A | 9/2000 | Bartges et al. | |

FOREIGN PATENT DOCUMENTS

| | | |
|---|---|---|
| EP | 0 982 410 | 3/2000 |
| JP | 2-85331 | 3/1990 |
| JP | 2000-328168 | 11/2000 |
| JP | 2001-107169 | 4/2001 |

OTHER PUBLICATIONS

J. R. Davis, "Metals Handbook, Desk Edition", 1998, pp. 869, ASM International, Ohio USA.

*Primary Examiner*—George Wyszomierski
*Assistant Examiner*—Janelle Combs Morillo
(74) *Attorney, Agent, or Firm*—Westerman, Hattori, Daniels & Adrian, LLP

(57) ABSTRACT

An aluminum alloy with good cuttability, containing 3 to 6 mass % of Cu, 0.2 to 1.2 mass % of Sn, 0.3 to 1.5 mass % of Bi, and 0.5 to 1.0 mass % of Zn, with the balance being aluminum and inevitable impurities. A method for producing a forged article, in which the aluminum alloy is utilized. A forged article obtained by the method.

3 Claims, No Drawings

ALUMINUM ALLOY WITH GOOD CUTTABILITY, METHOD FOR PRODUCING A FORGED ARTICLE, AND FORGED ARTICLE

FIELD

The present invention relates to an aluminum alloy or aluminum alloy material with good cuttability (machinability).

The present invention also relates to a method for producing a forged article using the alloy or alloy material.

The present invention also relates to a forged article obtained by the method above.

BACKGROUND

Conventionally, aluminum-based alloys prepared by adding Pb, such as JIS 2011 alloy and JIS 6262 alloy, have been used as aluminum alloys with good cuttability.

However, aluminum alloys having good cuttability without adding Pb have been required in recent years, in light of environmental problems.

While aluminum-based alloys prepared by adding Sn and Bi have been proposed as substitutes for the JIS 2011 alloy (prepared by adding Pb and Bi), their chip splittability is often inferior to the alloys prepared by adding Pb and Bi. In addition, chip splittability is insufficient when the rotation speed of the material is reduced or feed speed of the blade is slowed to comply with the requirement to reduce the surface roughness of the articles, compared with those conventionally made.

Further, when the alloy material prepared by adding Sn is subjected to hot-forging, cracks that are not found in the conventional alloys prepared by adding Pb and Bi are occurred in some cases in water-quenching after solution heat treatment carried out after forging.

SUMMARY

The present invention is an aluminum alloy with good cuttability, which comprises 3 to 6 mass % of Cu, 0.2 to 1.2 mass % of Sn, 0.3 to 1.5 mass % of Bi, and 0.5 to 1.0 mass % of Zn, with the balance being aluminum and inevitable impurities.

Further, the present invention is a method for producing a forged article, which comprises the step of: forging the above aluminum alloy, at a forging temperature of a material to be forged of 320 to 450° C.

Further, the present invention is a forged article obtained by the above producing method.

Other and further features and advantages of the invention will appear more fully from the following description.

DETAILED DESCRIPTION

According to the present invention, there are provided the following means:

(1) An aluminum alloy with good cuttability, comprising 3 to 6 mass % of Cu, 0.2 to 1.2 mass % of Sn, 0.3 to 1.5 mass % of Bi, and 0.5 to 1.0 mass % of Zn, with the balance being aluminum and inevitable impurities;

(2) A method for producing a forged article, comprising the step of: forging the aluminum alloy according to item (1), at a forging temperature of a material to be forged of 320 to 450° C.; and (3) A forged article, obtained by the method according to item (2).

The phrase "Pb is not added (not supplemented with)" as used herein means that no Pb is added in the ingot, and more specifically it means 0.05 mass % or less of content of Pb in the resulting aluminum alloy.

The present invention will be described in detail hereinafter.

Cu contributes to improving mechanical strength of the aluminum alloy of the present invention, by forming a compound, such as $CuAl_2$. The effect is small in the range below the lower limit of the content of Cu, and the quality of the surface of the ingot decreases in the range above the upper limit of the content of Cu. The preferable content of Cu is 4.5 to 5.5 mass %.

Low-melting-point elements, such as Sn and Bi, improve chip splittability. Since Sn and Bi form almost no solid solution with aluminum, they exist as compounds. It is assumed that chip splittability is improved because the compounds melt at the tip of a cutting or drilling blade due to heat in working, to generate notches on the chips. This effect is insufficient at below the lower limits of the contents of Sn and Bi, and corrosion resistance decreases above the upper limit contents, due to occurrence of grain boundary corrosion. Since the melting point of the Sn—Bi compound decreases to 139° C., in contrast to the melting points of pure Sn of 232° C. and pure Bi of 271° C., the effect of melting of the compound becomes evident. Accordingly, adding both Sn and Bi is preferable, and they are preferably contained in an Sn-to-Bi mass ratio of about 43:57, which causes a eutectic composition. The content of Sn is preferably 0.2 to 0.8 mass %. The content of Bi is preferably 0.3 to 1.0 mass %.

Hitherto, chip splittability of the aluminum-based alloy material prepared by adding Sn and Bi has been inferior to that of the material prepared by adding Pb and Bi in some cases. The present inventors found the reason to be as follows, as a result of intensive studies. Since the Sn—Bi compound has a smaller size than the Pb—Bi compound, notches having a size sufficient to split the chips cannot be formed, in some cases of specific cutting conditions.

Accordingly, the present inventors have found that Zn is to be added, with addition of Bi in a content of 0.3 mass % or more, to increase the size of the compound. That is, it has been found that the size of the Sn—Bi compound increases by introducing Zn into the Sn—Bi compound. For example, in the example described later, the average grain diameter of the Sn—Bi compound became as large as 8 $\mu$m in Sample 2 according to the present invention, in contrast to the average grain diameter of 5 $\mu$m of the Sn—Bi compound in Sample 9 of a comparative example. This shows that the size of the Sn—Bi compound in the sample according to the present invention was almost equal to that of the Pb—Bi compound in JIS 2011 alloy as a conventional example. Consequently, notches having sufficient size are formed, to improve chip splittability. The average grain diameter of the Sn—Bi compound is preferably 8 $\mu$m or above, more preferably 10 $\mu$m or above. The above effect is insufficient at a Zn content of below the lower limit, and corrosion resistance is deteriorated at a content above the upper limit. The Zn content is preferably 0.5 to 0.8 mass %.

Other elements are not particularly restricted in the alloy of the present invention. Elements like Si, Fe, Mn, Mg, Ti, Ni, Cr, Zr, and In may be contained, in ranges not inhibiting the various properties of the alloy of the present invention, such as mechanical strength, moldability, cuttability, and corrosion resistance.

The manufacturing conditions and tempering of the alloy of the present invention are also not particularly restricted. Tempering suitable for the application may be selected under the usual production conditions. For example, the alloy may be T1 temper by a hot-processing finish; T6 temper by applying solution heat treatment and artificial aging; or T8 temper by applying solution heat treatment, cold-processing, and artificial aging. Further, tempers like T3, T8, T6, and T9, in which the alloy is subjected to cold-processing or artificial aging after solution heat treatment are also preferable, since chip splittability becomes better when the mechanical strength is greater.

In the present invention, the temperature of the material for forging is preferably 320 to 450° C. and more preferably 350 to 420° C., when the alloy material is processed by forging.

Cracks that are not found in the conventional alloys prepared by adding Pb and Bi are occurred in some cased in water-quenching after solution heat treatment carried out after forging when the alloy material prepared by adding Sn is subjected to hot forging. The present inventors found the reason to be as follows, through intensive studies. When the alloy is forged at a high temperature exceeding 450° C., giant recrystallized crystalline grains are formed, and a large stress is applied to the recrystallized crystalline grain boundary by water-quenching applied after solution heat treatment. The total area of grain boundaries in the material having the giant recrystallization crystalline grains is so small that the stress applied on a unit area of the grain boundaries is increased, to readily cause cracks. Although the cracks are occurred in the conventional aluminum-based alloy material prepared by adding Pb and Bi when the further giant recrystallized crystalline grains are formed, the incidence of cracks is not as large as in the aluminum-based alloy material prepared by adding Sn, such as the alloy material of the present invention.

On the other hand, deformation resistance of the material increases when the temperature of the material is lowered during forging. It may be conjectured that the forging load may exceed the capacity of a press machine by the increase of deformation resistance. However, since the deformation resistance is small in the alloy of the present invention, as compared with the conventional aluminum alloy material prepared by adding Pb and Bi, low-temperature forging is possible. The forging load may be increased at a temperature lower than 320° C., depending on the shape of the article to be obtained by forging. Lowering the temperature of the material during forging is advantageous with respect to energy cost.

The aluminum alloy of the present invention can be used, for example, for members or parts that are subjected to machining, such as cutting and drilling.

The aluminum alloy of the present invention has good cuttability that is equal or superior to the alloy prepared by adding Pb, by adding a prescribed amount of Sn and Bi, and adding Zn, even if Pb is not added, in the Al—Cu-series alloy.

According to the method of the present invention for producing a forged article, forging is possible at a lower temperature with a smaller load, to enable energy-saving forging while preventing cracks from occurring in the forging process (for example, in the water quenching after solution heat treatment after forging).

The present invention will be described in more detail based on examples given below, but the invention is not meant to be limited by these examples.

EXAMPLE

Example 1

The alloys with the compositions, as shown in Table 1, were melted, and ingots of diameter 220 mm were obtained from the respective molten alloys. These ingots were heated for homogenization at 480° C. for 6 hours. Extrusion rods of diameter 12 mm were obtained by extruding these ingots at 400° C. Then, after solution heat treatment at 500° C. for 2 hours, the rods were immediately quenched with water.

These rods were subjected to a cutting test by external cutting. Cutting conditions were a rotation speed of 3000 rpm, cutting depth of 2 mm, and a feed rate of 0.1 mm/rev. Chip splittability was evaluated by the mass of the chips (debris) per 100 pieces of chips. Evaluation criteria are: a mass of 2 g or less was evaluated as A; a mass of more than 2 g and 4 g or less was evaluated as B; a mass of more than 4 g and 6 g or less was evaluated as C, and a mass of larger than 6 g was evaluated as D. Cuttability (chip splittability) is judged to be better as the mass of the chips is smaller.

As is apparent from the results shown in Table 1, Samples 9 to 12 of the comparative examples and Sample 13 (JIS 2017 alloy) of a conventional example were poor in cuttability, as they did not contain Pb. On the contrary, Samples 1 to 8 according to the present invention, in which no Pb was added, had similar level of or superior cuttability (chip splittability) to the alloy supplemented with Pb that is a conventional example (Sample 14, JIS 2011 alloy). Accordingly, it can be understood that the alloys according to the present invention simultaneously supplemented with Cu, Sn, Bi, and Zn are particularly excellent in chip splittability.

TABLE 1

| Remarks | Sample | Si | Fe | Cu | Mn | Mg | Cr | Ni | Zn | Ti | Zr | Sn | Bi | Pb | Cuttability |
|---|---|---|---|---|---|---|---|---|---|---|---|---|---|---|---|
| This invention | 1 | 0.18 | 0.24 | 5.92 | 0.00 | 0.00 | 0.00 | 0.00 | 0.96 | 0.00 | 0.00 | 0.88 | 1.19 | 0.00 | A |
| | 2 | 0.19 | 0.24 | 5.02 | 0.00 | 0.00 | 0.01 | 0.00 | 0.53 | 0.01 | 0.00 | 0.61 | 0.69 | 0.00 | A |
| | 3 | 0.24 | 0.23 | 5.55 | 0.00 | 0.23 | 0.00 | 0.00 | 0.53 | 0.00 | 0.00 | 0.46 | 1.47 | 0.00 | A |
| | 4 | 0.18 | 1.01 | 5.34 | 0.00 | 0.00 | 0.00 | 0.00 | 0.63 | 0.00 | 0.00 | 0.57 | 0.69 | 0.00 | A |
| | 5 | 0.22 | 0.24 | 4.81 | 0.00 | 0.00 | 0.00 | 0.00 | 0.78 | 0.10 | 0.00 | 0.54 | 0.71 | 0.00 | A |
| | 6 | 0.76 | 0.22 | 5.77 | 0.00 | 0.00 | 0.01 | 0.00 | 0.56 | 0.01 | 0.00 | 0.65 | 0.82 | 0.00 | A |
| | 7 | 0.22 | 0.23 | 5.54 | 0.01 | 0.00 | 0.11 | 0.00 | 0.64 | 0.00 | 0.07 | 0.74 | 0.84 | 0.00 | A |
| | 8 | 0.17 | 0.21 | 4.38 | 0.46 | 0.01 | 0.00 | 0.00 | 0.50 | 0.01 | 0.00 | 0.55 | 0.67 | 0.00 | A |
| Comparative example | 9 | 0.18 | 0.23 | 5.55 | 0.01 | 0.00 | 0.00 | 0.00 | 0.01 | 0.01 | 0.00 | 0.61 | 0.66 | 0.00 | C |
| | 10 | 0.20 | 0.23 | 2.56 | 0.00 | 0.01 | 0.00 | 0.01 | 0.25 | 0.01 | 0.01 | 0.57 | 0.53 | 0.00 | C |
| | 11 | 0.21 | 0.19 | 5.42 | 0.00 | 0.00 | 0.01 | 0.00 | 0.54 | 0.01 | 0.00 | 0.11 | 0.73 | 0.00 | C |
| | 12 | 0.20 | 0.23 | 5.61 | 0.01 | 0.01 | 0.00 | 0.00 | 0.48 | 0.01 | 0.00 | 0.51 | 0.24 | 0.00 | C |

TABLE 1-continued

| Remarks | Sample | Si | Fe | Cu | Mn | Mg | Cr | Ni | Zn | Ti | Zr | Sn | Bi | Pb | Cuttability |
|---|---|---|---|---|---|---|---|---|---|---|---|---|---|---|---|
| Conventional example | 13 (JIS 2017) | 0.52 | 0.47 | 4.03 | 0.55 | 0.61 | 0.01 | 0.00 | 0.01 | 0.01 | 0.00 | 0.00 | 0.00 | 0.00 | D |
| | 14 (JIS 2011) | 0.18 | 0.20 | 5.53 | 0.00 | 0.01 | 0.00 | 0.00 | 0.00 | 0.00 | 0.00 | 0.00 | 0.59 | 0.61 | B |

Mass %; The balance being aluminum

Example 2

Ingots of diameter 340 m were obtained using two kinds of alloys, that is, an alloy of the present invention and a conventional JIS 2011 alloy, as shown in Table 2. These ingots were heated for homogenization at 480° C. for 6 hours. The ingots were processed into extrusion rods of diameter 35 mm, by extrusion at 400° C. These rods were cut into lengths of 35 mm, as forging stocks, and the stocks were upset, with a upsetting ratio of 80%, at the forging temperatures as shown in Table 2. Table 2 shows the minimum forging load (ton) required for processing at each forging temperature. Then, after subjecting to solution heat treatment at 500° C. for 2 hours, the samples were immediately quenched with water. The samples were evaluated with respect to: (1) the magnitude of forging load at each forging temperature; and (2) whether cracks were occurred or not by observing by means of color checking (visible dye) after quenching with water.

A testing procedure on the color checking (visible dye; for example, see MIL-STD-6866) is explained below. A penetrant (red color) was sprayed on each of the above-obtained forged article samples, and then the sprayed forged article samples were left for about 15 minutes. After the penetrant was wiped off from the surface of the forged article samples, developing solution (white color) was sprayed on the forged article samples. If there is any cracks on the forged article samples, the penetrant (red color) exudes from the cracked portion after spraying the developing solution on the forged article, since the penetrant has been soaked into the cracked portion. The samples were observed whether the red-colored solution exuded from the cracks or not, and it is judged that there were no cracks when the exuding red-colored solution was not observed, and that there were cracks when the exuding red-colored solution was observed.

As is apparent from the results shown in Table 2, the forging load of the conventional JIS 2011 alloy was conspicuously larger than that of the alloy A at the same forging temperature. In contrast, the forging load was remarkably low, with no cracks on the forged articles, when the alloy A satisfying the definition in the present invention was processed at a prescribed forging temperature (320 to 450° C.). However, cracks were occurred at higher forging temperatures, and a large forging load was required at lower temperatures, even when the alloy A satisfying the definition in the present invention was used. These results show that it is preferable to adjust the temperature of the material at a prescribed forging temperature, when the alloy of the present invention is processed by forging.

TABLE 2

| Sample | Alloy | Forging temperature (° C.) | Forging load (ton) | Cracks after quenching with water |
|---|---|---|---|---|
| 15 | A | 490 | 138 | Observed |
| 16 | | 460 | 146 | Observed |
| 17 | | 430 | 157 | Not observed |
| 18 | | 400 | 169 | Not observed |
| 19 | | 370 | 178 | Not observed |
| 20 | | 340 | 189 | Not observed |
| 21 | | 310 | 203 | Not observed |
| 22 | JIS 2011 | 490 | 163 | Observed |
| 23 | | 460 | 170 | Not observed |
| 24 | | 430 | 182 | Not observed |
| 25 | | 400 | 193 | Not observed |
| 26 | | 370 | 207 | Not observed |
| 27 | | 340 | 223 | Not observed |
| 28 | | 310 | 235 | Not observed |

Note: Alloy A: Cu 5.24 mass %, Sn 0.58 mass %, Bi 0.67 mass %, Zn 0.52 mass %, balance Al JIS 2011 alloy: Cu 5.18 mass %, Pb 0.51 mass %, Bi 0.54 mass %, balance Al Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy with good cuttability, comprising 3 to 6 mass % of Cu, 0.2 to 1.2 mass % of Sn, 0.3 to 1.5 mass % of Bi, and 0.5 to 1.0 mass % of Zn, with the balance being aluminum and inevitable impurities.

2. A method for producing a forged article, comprising the step of: forging the aluminum alloy according to claim 1 at a forging temperature of a material to be forged of 320 to 450° C.

3. A forged article, obtained by the method according to claim 2.

* * * * *